United States Patent [19]

Newman

[11] Patent Number: 4,519,557

[45] Date of Patent: May 28, 1985

[54] PLASTIC BOBBIN

[76] Inventor: Arnold Newman, 4170 Cove La., Glenview, Ill. 60025

[21] Appl. No.: 444,618

[22] Filed: Nov. 26, 1982

[51] Int. Cl.[3] ..... B65H 75/10; B65H 75/20

[52] U.S. Cl. ..... 242/118.31; 220/72; 242/118.3; 242/118.32

[58] Field of Search ..... 242/118, 118.3, 118.31, 242/118.32; 220/72

[56] References Cited

U.S. PATENT DOCUMENTS

| | | | |
|---|---|---|---|
| 2,535,188 | 12/1950 | Beckner | 242/118.3 |
| 3,141,631 | 7/1964 | Krebs | 242/118.3 |
| 3,450,370 | 6/1969 | Hawkins | 242/118.32 |
| 3,532,291 | 10/1970 | Newman | 242/118.31 |
| 4,205,423 | 6/1980 | Poole et al. | 242/118.3 X |

FOREIGN PATENT DOCUMENTS

| | | | |
|---|---|---|---|
| 707926 | 4/1954 | United Kingdom | 242/118.32 |

*Primary Examiner*—Stuart S. Levy
*Assistant Examiner*—Katherine Jaekel
*Attorney, Agent, or Firm*—Robert E. Browne; Ralph R. Rath

[57] ABSTRACT

A plastic bobbin consisting of a hollow cone defined by a thin-walled sheath includes an inner skeletal frame of longitudinally-spaced circumferential ribs and radially-spaced longitudinal ribs defining an inner support surface for a mandrel with a sheath having segments of varying wall thickness and the outer surface having a constant taper with respect to the bobbin axis. Some of the longitudinally-extending ribs may be partial ribs defined in each of the segments.

13 Claims, 5 Drawing Figures

PLASTIC BOBBIN

TECHNICAL FIELD

This invention relates generally to cores upon which filamentary material such as yarn or thread are to be wound and, more particularly, to an improved lightweight bobbin fashioned as a one-piece hollow cone molded from plastic material. One such material found to be useful is polypropylene, which allows certain features of the bobbin to be molded in precise detail.

For purposes of simplicity, the filamentary materials with which the present invention is intended to be used will be referred to generally as "yarn", with the understanding that other filamentary materials are included as well.

BACKGROUND PRIOR ART

Manufacture of yarn is carried out as a continuous operation, and as part of the manufacturing process, machines have been developed to automatically package yarn by winding it onto bobbins for storage, shipment, and sale.

In a typical example, one such winding machine has a mandrel which rotates at a selectable speed, and onto which an empty bobbin or core is placed. Such mandrels may grip the bobbin with teeth, rubber collars, expandable and retractable "dogs", or O-rings. Various adjustments are then possible to alter the angle at which the yarn is wound, the tension on the yarn during winding, and the speed at which the bobbin is spun. Yarn is then wound onto the bobbin, preferably in a uniform pattern, until the desired quantity of yarn is loaded, and the full bobbin is then removed from the mandrel and replaced with an empty one.

Each such bobbin is thus required to withstand compressive forces occasioned by the winding of the yarn, the high-speed rotation of the bobbin, and the centrifugal forces created in the bobbin. Customarily, many such bobbins are cone-shaped, and the stresses incurred during winding are complex because the bobbin does not have a uniform cross-sectional configuration throughout its length.

Accordingly, bobbins manufactured for use with automatic winding machines must be strong enough structurally to withstand the rotational stresses induced during winding and must facilitate insertion onto and removal from the mandrel of the winding machine. As winding machines of different manufacturers vary in their constructions, so mandrel configurations and constructions differ, and the bobbin should preferably be constructed for use with a variety of mandrels.

Another important consideration is maintaining a close fit between the bobbin and the mandrel which will limit slippage, yet which will allow easy removal of the bobbin from the mandrel when winding is complete.

It has also been shown to be advantageous to have some form of guiding structure formed on the bobbin's outer surface to direct the first layer of yarn to be wound uniformly along the bobbin, making it possible for tight, uniform winding of yarn which maximizes the amount of yarn carried on each bobbin, and facilitates dispensing of the yarn by the ultimate user. Past efforts in this area have included forming a series of concentric raised rings on the surface of the cone in order to grip the yarn during the first stages of winding. Another prior attempt to attract and direct the winding of the yarn is to "stipple" the surface of the bobbin with small, raised "dots". Typically, the surface of the stippled bobbin has a sand paperlike feel, and prolonged handling of such bobbins is likely to abrade the user's hands unless gloves are worn.

SUMMARY OF THE INVENTION

The present invention is intended to accomplish these desired results with a bobbin which is lightweight, strong, and usable on a variety of mandrels, yet which uses less raw material to manufacture, and does not require the use of gloves when handling.

The present invention offers advantages and improvements over prior bobbins. Exemplary of the prior art is my U.S. Pat. No. 3,532,291, showing the one-piece molded construction and reinforcing internal rib system currently in use.

A thin-walled outer sheath is internally supported by a skeleton of axially-extending, radially spaced-apart ribs which intersect axially-spaced, circumferentially extending ribs, with the entire bobbin cast as a single, unitary structure from a plastic such as polypropylene. A series of circumferentially-extending concentric ridges is formed on the exterior surface of the sheath to form a surface for the collection and winding of yarn.

Other examples of bobbin constructions may be found in U.S. Pat. Nos. 2,273,373, 3,450,370, 3,900,168 in British Patent Nos. 707,926, and 1,240,771, and in USSR Patent No. 258,955. As will become more clear below, the prior efforts noted above have not resulted in the improved construction set forth herein.

BRIEF DESCRIPTION OF THE INVENTION

In accordance with one aspect of the present invention, the outside surface of the bobbin sidewalls are formed with a constant slope, or "true taper", while the inner bobbin sidewalls vary in thickness along selected axial segments thereof, with some inner wall segments formed at a true taper, and others at a different taper. Reinforcing ribs of uniform thickness are formed both axially and radially on the inner bobbin surface. Such a construction uses significantly less plastic material while maintaining the compressive strength required for use as a bobbin.

In yet another aspect of the invention, partial axially-extending skeletal ribs formed on the interior surface of the bobbin reinforce the thinner wall sections described above.

Yet another aspect of the present invention includes a ridge formed on the exterior surface of the bobbin and extending circumferentially therearound from one end to the other in a helical pattern, with the crest of the ridge formed as a saw toothed edge, rather than a rounded edge.

Another aspect of the invention is a circumferentially-extending inner reinforcing segment proximate the base of the bobbin. The reinforcing segment has a gripping surface formed thereon to create a tighter and more reliable fit on the mandrel of a yarn-winding apparatus.

Further aspects of the present invention will become more apparent upon consideration of the accompanying drawings and the detailed description of the invention which follows.

DETAILED DESCRIPTION OF THE INVENTION

Figure 1:
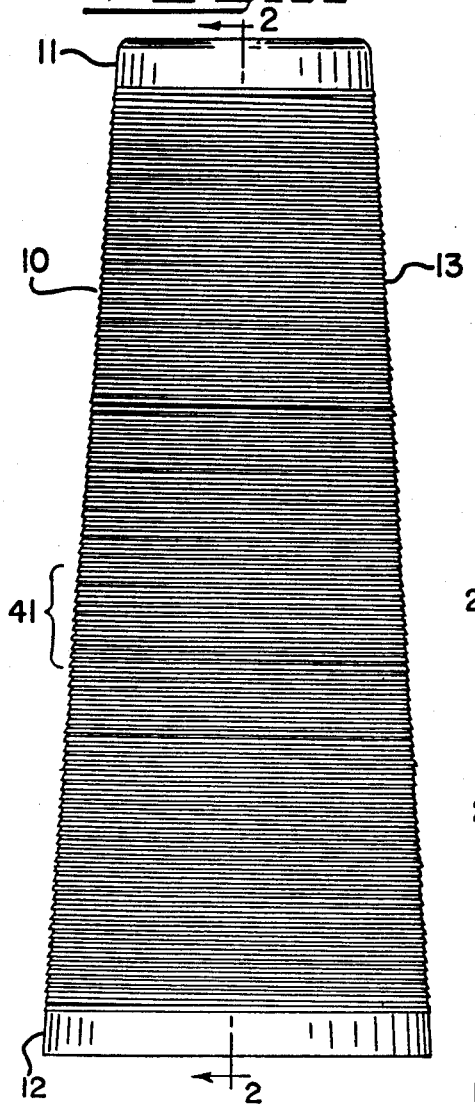
FIG. 1 is an elevation of the exterior of a bobbin incorporating aspects of the present invention.

Referring now to FIG. 1, the numeral 10 indicates generally a bobbin or core made from plastic material, such as polypropylene, formed generally in a frustoconical configuration, and having a top section or tip end 11 and a bottom section or base end 12. Intermediate tip end 11 and base end 12, the exterior surface of bobbin 10 has formed thereon a single raised continuous helical thread 13 which, in one embodiment of the present invention, comprises a saw-toothed ridge wrapped in the shape of a helix on the otherwise smooth surface of bobbin 10 as shown in greater detail in FIG. 4.

Figure 2:
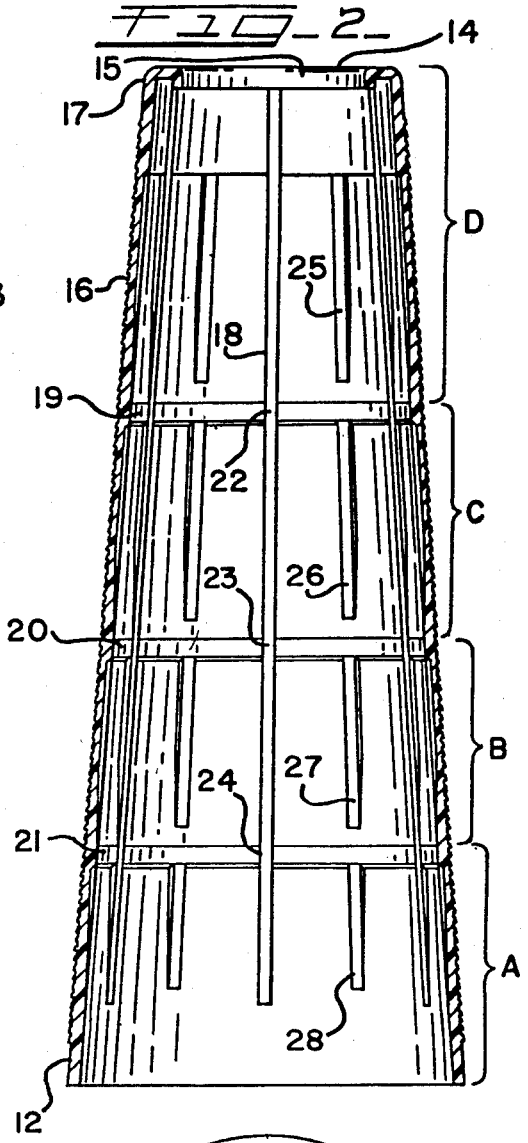
FIG. 2 is a sectional view taken along 2—2 of FIG. 1.

Referring now to FIG. 2, tip end 11 is shown having a dome-shaped top 14 surrounding a central aperture 15. Aperture 15 is better seen in FIG. 3. As seen in FIG. 2, the relative thickness of the bobbin sidewall 16 at tip end 11, and the configuration of the dome-shaped top 14 act to reinforce tip end 11.

It should be understood throughout this description of the present invention that, although certain features or embodiments are described as being "formed on" the bobbin, the bobbin is, in its preferred form, injection-molded as a unitary structure, and all of the structure so described is integral with the bobbin. In other words, in its preferred form, the bobbin is a one-piece construction, rather than a substrate with various surface details added thereto such as by adhesives or fasteners.

Figure 3:
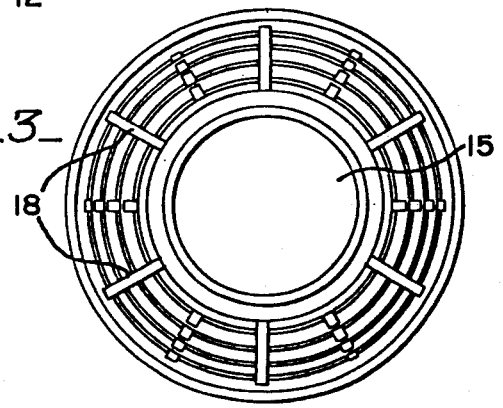
FIG. 3 is a bottom view of the embodiment illustrated in FIG. 2.

As best seen in FIGS. 2 and 3, a preferred embodiment of the present invention has a series of longitudinally or axially extending skeletal ribs formed on the interior of bobbin 10. In FIG. 2, one embodiment of the present invention includes a number of full ribs 18 which extend from tip end 11 to a point proximate base end 12. In FIG. 3, the construction illustrated utilizes a series of six such full ribs equally spaced about the interior surface of bobbin 10.

Also illustrated in FIG. 2 is a series of circumferentially extending skeletal, or circular ribs, 19, 20, and 21. Ribs 19, 21, and 21 are formed concentrically along the axis of bobbin 10, and intersect full ribs 18 at, for example, junctures 22, 23 and 24 of FIG. 2.

The embodiment depicted in FIG. 2 also includes a series of shortened or partial longitudinally extending ribs exemplified by the numerals 25, 26, 27 and 28. Generally, each such partial rib, when viewed within bobbin 10, appears thickest where it intersects a circular rib, and thereafter appears to blend in with the inner surface bobbin 10. The nature and character of the construction of such partial ribs will be more extensively developed hereinafter, when further details of the sidewall construction of bobbin 10 are discussed.

Figure 4:
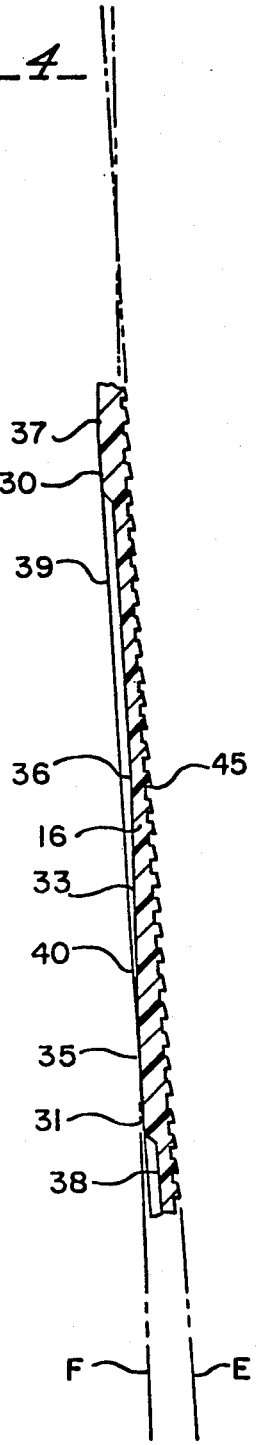
FIG. 4 is a partial sectional view of the wall of the embodiment shown in FIG. 2.

Referring now to FIGS. 2 and 4, and, more particularly, to the details of construction of the sidewalls of bobbin 10, it can be seen that at various points along the length of bobbin 10, the thickness of the sidewall 16 varies. In the embodiment shown in FIG. 2, longitudinal segments of cone 10 have been divided, for purposes of illustration into segments A, B, C, and D, and a partial side sectional view representative of one such section is shown in FIG. 4. The segment in FIG. 4 extends from a first circular rib 30 downward to a second circular rib 31, as a typical section. As seen in FIG. 4, the exterior surface 32 of sidewall 16 is formed with a constant taper relative to the axis of bobbin 10, as illustrated by line E. One such taper utilized in such bobbins is 5°57′ as measured by a line coextensive with the outer bobbin wall intersecting the axis of the bobbin.

As typified by line F, an interior surface segment 33 of sidewall 16 is formed with a taper which differs from that of exterior surface 32. The result of such a taper is to create a wall section with segments of varying thickness. One such taper (measured in the same fashion as the true taper), found to be effective is approximately 5°54′.

The embodiment in FIG. 4 is characterized by a sidewall construction at which the wall is at its thickest at 35, that is, at its juncture with the upper part of circular rib 31, and which thereafter tapers to narrow until it reaches point 36, and thereafter continues at a uniform thickness until it meets circular rib 30. Another such construction may have the taper continue from circular rib 31 where it meets circular rib 30. As seen in FIG. 4, the next upper most wall section 37 begins with a thickened segment at the top of circular rib 30, while the next subjacent wall section 38 terminates with a narrowed portion at circular rib 31.

In this fashion, less plastic material is required to manufacture each bobbin 10 while the arrangement of full and partial longitudinal ribs, and circular ribs, provides the bobbin construction with the strength to resist the compressive and centrifugal forces described hereinabove, encountered when bobbin 10 is placed upon a spinning mandrel and used to wind yarn.

As seen in FIG. 4, partial rib 39 is actually of substantially constant thickness, and follows the taper of the inner wall segment. The lower end of rib 39 blends in with sidewall 16 as at 40, when the thickness of the sidewall matches the maximum thickness of sidewall 16. Thus, with respect to the partial ribs, at least a portion of each such rib is equal to or less than thickness of one portion of sidewall 16. With respect to longitudinal rib 18, said rib is formed with a thickness which equals the maximum thickness of wall section 16, and is formed with the same inner taper as the outer taper of sidewall 16 of bobbin 10. A preferred embodiment of the circular ribs shown at, for example, 30 and 31 of FIG. 4 has each such circular rib formed with a constant thickness.

Thus, in one version of the present invention, bobbin 10 has a first section A within which the wall thickness tapers upward from base end 12 to first circular rib 21, a second section B with a thickened base tapering upward to circular rib 20, a third section C with a wall section tapering upward to circular rib 19 and a fourth section D with a wall section which tapers upward to tip end 11.

Referring now to FIGS. 1 and 4, the numeral 41 indicates generally the raised, helically formed saw-tooth thread formed about the circumference of bobbin 10. As seen in FIG. 4, said threads 41 are formed with sharp, downwardly-facing edges 45 which enables the surface of cone 10 to more effectively snag a yarn segment to initiate the winding operation, yet which allows for easy removal of the finished bobbin from its mold.

Figure 5:
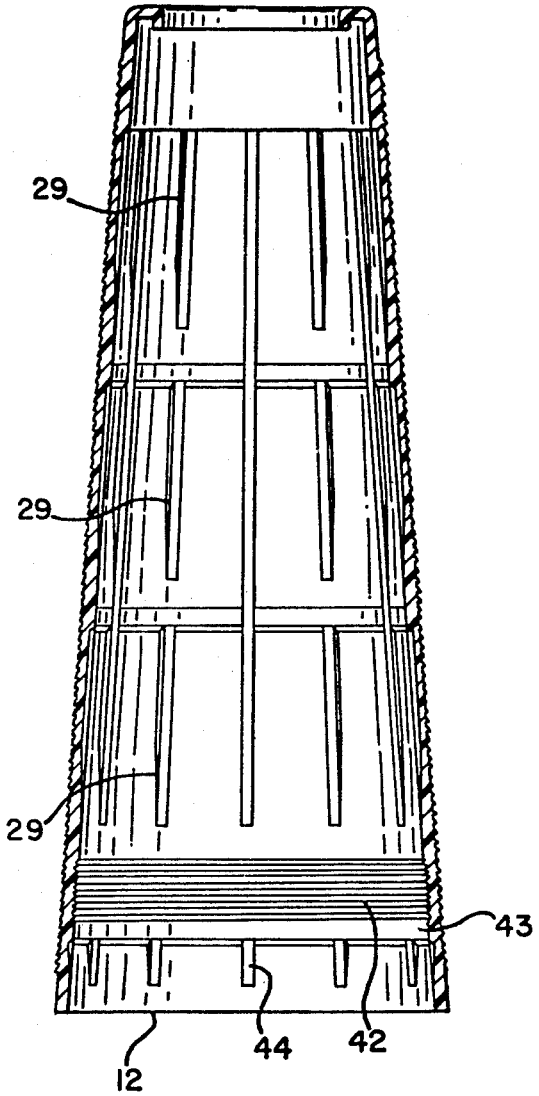
FIG. 5 is a sectional view of a second embodiment of the present invention.

In yet another preferred embodiment, illustrated in FIG. 5, bobbin 10 has internally-formed surface grooves 42 about a section of the inner periphery of bobbin 10 proximate base end 12. The grooves so formed provide a gripping segment which enhances the holding of bobbin 10 on the mandrel of an automatic winding apparatus. Preferably, grooves 42 are formed to be contiguous with a circular rib such as 43, and a series of shortened partial ribs 44 may also be formed in order to reinforce the base end 12 of bobbin 10. Grooves 42 also provide advantages in separating bobbins which are shipped nested one within the other, and in removing bobbin 10 from a mandrel once winding is complete.

Grooves 42, and full ribs such as 18, form a bearing surface for a mandrel. At least three such ribs 18, formed with a true taper and constant thickness, equal to or exceeding the maximum wall thickness of bobbin 10, are spaced equidistantly about the inner periphery of bobbin 10. A preferred version of bobbin 10 utilizes six such full or true taper ribs alternating with axially-spaced files of partial ribs. Full ribs 18 should be spaced uniformly about the interior of bobbin 10 such that each full rib is the same distance from its preceding and following full ribs, i.e., three full ribs would be placed at 120° intervals, four full ribs at 90° intervals, five full ribs at 72° intervals, six full ribs at 60° intervals, etc.

As seen in FIG. 5, use of partial ribs 29 and 44 can represent a greater saving of raw material, where no such ribs hereto exceeds the thickness of sidewall 16 throughout the entire length of bobbin 10. In one such version of bobbin 10, use of partial ribs and varying wall thicknesses enabled the saving of 2½ pounds of polypropylene per 1,000 bobbins.

Placement of circular ribs such as 29, 30 and 31 may vary with the size and exterior taper of bobbin 10. As seen in FIG. 5, circular rib 43 and grooved section 42 combine to reinforce base end 12.

While the foregoing has described certain specific embodiments of the present invention, it is to be understood that these embodiments are being presented by way of example only. It is expected that others skilled in the art will perceive variations which, while differing from the foregoing, do not depart from the spirit and scope of the invention as herein described and claimed.

I claim:

1. A bobbin construction to be gripped by a mandrel, said bobbin being of the type having the configuration of a one-piece hollow cone having a central axis, said cone molded of plastic, said cone having a tip end and a base end, a thin-walled sheath having an inner surface and an outer surface, and an inner skeletal frame of longitudinally-spaced circumferential ribs and circumferentially-spaced longitudinal ribs supporting said sheath, said bobbin comprising:

said outer surface formed at a first constant taper with respect to said axis;

at least one section of said inner surface formed at a second taper, each said inner surface section and said outer surface defining therebetween a sheath segment of varying thickness;

said longitudinal ribs including at least one partial rib in said varying thickness sheath segment having a substantially constant thickness to produce a varying thickness rib in said varying thickness sheath segment;

means formed on said inner surface to provide a gripping site for said mandrel; and, a circumferentially-extending ridge formed in said outer surface extending in a helical pattern from proximate said base end to proximate said tip end.

2. The apparatus as recited in claim 1 wherein said first constant taper is an angle of about 5°57′ with respect to said axis.

3. The apparatus as recited in claim 1 wherein said mandrel-gripping means includes a thickened, longitudinally-extending circumferential shoulder formed on said inner surface proximate said base end.

4. The apparatus as recited in claim 3 wherein said shoulder has a plurality of longitudinally spaced and circumferentially extending ridges formed thereon.

5. The apparatus as recited in claim 3 said mandrel-gripping means includes at least three of said longitudinally-spaced and circumferentially extending ridges

6. The apparatus as recited in claim 1 wherein at least three of said longitudinal ribs are formed with the same taper as said outer surface.

7. The apparatus as recited in claim 1 wherein at least three of said longitudinal ribs are formed with a constant thickness when measured from said outer surface.

8. The apparatus as recited in claim 1 wherein said bobbin includes at least three said tapered inner surface sections.

9. The apparatus as recited in claim 1 wherein each said tapered inner surface section includes a first segment along which said inner surface is inclined with respect to said outer surface, and a second segment contiguous with said first segment, along which said inner and outer surfaces are substantially parallel.

10. The bobbin construction as recited in claim 1, in which at least one of said circumferential ribs is located adjacent the point of maximum thickness of said sheath segment and said partial rib extends from said maximum thickness rib and merges with said inner surface.

11. A bobbin construction, said bobbin of the type having a configuration of a one-piece hollow cone having a central axis, sid cone molded of plastic, said cone having a tip end and a base end, a thin-walled sheath having an inner surface and an outer surface, and an inner skeletal frame of longitudinally-spaced circumferential ribs and circumferentially-spaced longitudinal ribs supporting said sheath, said bobbin comprising:

a plurality of contiguous, frusto-conical segments and extending from said base end, with a portion of said inner surface included in each said segment inclined with respect to said outer surface to form sheath segments of varying thickness;

a plurality of partial ribs in each segment and having a substantially constant thickness with respect to said outer surface, thereby defining tapered partial ribs in each segment; and, said outer surface formed at a constant taper with respect to said axis.

12. The bobbin construction as defined in claim 11, in which said longitudinal ribs extend from said tip end to said base end and each have a substantially constant thickness with respect to said outer surface.

13. The bobbin construction as defined in claim 11, in which said partial ribs have a maximum thickness at one end adjacent said circumferential ribs and merge with said inner surface at opposite ends.

* * * * *